US011013967B2

(12) United States Patent
Chauvin et al.

(10) Patent No.: US 11,013,967 B2
(45) Date of Patent: May 25, 2021

(54) BALL BATS WITH REDUCED DURABILITY REGIONS FOR DETERRING ALTERATION

(71) Applicant: EASTON DIAMOND SPORTS, LLC, Thousand Oaks, CA (US)

(72) Inventors: Dewey Chauvin, Simi Valley, CA (US); Frederic St-Laurent, Oak Park, CA (US); Mick Kaplan, Taipei (TW); Ian Montgomery, Simi Valley, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

(21) Appl. No.: 16/132,199

(22) Filed: Sep. 14, 2018

(65) Prior Publication Data

US 2019/0022484 A1 Jan. 24, 2019

Related U.S. Application Data

(63) Continuation-in-part of application No. 15/654,513, filed on Jul. 19, 2017.

(51) Int. Cl.
*A63B 59/50* (2015.01)
*A63B 59/54* (2015.01)
(Continued)

(52) U.S. Cl.
CPC ..... *A63B 59/50* (2015.10); *A63B 59/54* (2015.10); *A63B 59/56* (2015.10);
(Continued)

(58) Field of Classification Search
CPC ..... A63B 59/50; A63B 59/51; A63B 59/52; A63B 59/54; A63B 2102/18; A63B 2209/02; A63B 2209/023
(Continued)

(56) References Cited

U.S. PATENT DOCUMENTS 1,611,858 A 12/1926 Middlekauff
4,014,542 A 3/1977 Tanikawa
(Continued)

FOREIGN PATENT DOCUMENTS

CA 2577184 C 4/2014
CN 1067388 A 12/1992
(Continued)

OTHER PUBLICATIONS

ASTM International, F2219—14 Standard Test Methods for Measuring High-Speed Bat Performance, USA Baseball ABI Protocol, May 2016.

(Continued)

*Primary Examiner* — Joseph B Baldori
(74) *Attorney, Agent, or Firm* — Perkins Cole LLP

(57) ABSTRACT

A ball bat includes a barrel wall with a composite laminate structure that includes an outwardly facing skin, an inwardly facing skin, a stack of composite laminate plies positioned between the outwardly facing skin and the inwardly facing skin, and a discontinuity in the stack forming a gap along a longitudinal axis of the bat. A rigid or semi-rigid appliance may be positioned in the gap. The appliance may be a ring element, which may have a cross-section that traverses the composite laminate plies in the stack in a direction that is perpendicular or oblique to the longitudinal axis of the bat. The cross-section of the ring element may be triangular. A second ring element may be positioned in the barrel wall. The second ring element may be connected to the other ring element with an adhesive bond or a connecting element.

14 Claims, 9 Drawing Sheets

(51) Int. Cl.
*A63B 59/56* (2015.01)
*A63B 102/18* (2015.01)

(52) U.S. Cl.
CPC ..... *A63B 2102/18* (2015.10); *A63B 2102/182* (2015.10); *A63B 2209/00* (2013.01); *A63B 2209/02* (2013.01); *A63B 2209/023* (2013.01)

(58) Field of Classification Search
USPC ..... 473/564, 566, 567
See application file for complete search history.

(56) References Cited

U.S. PATENT DOCUMENTS 4,025,377 A 5/1977 Tanikawa
4,132,130 A 1/1979 Fletcher et al.
4,150,291 A 4/1979 Gulley
4,505,479 A 3/1985 Souders
4,604,319 A 8/1986 Evans
4,780,346 A 10/1988 Denoel
4,804,315 A 2/1989 Ferris et al.
4,818,584 A 4/1989 Eisenmann
4,848,745 A 7/1989 Bohannan et al.
4,867,399 A 9/1989 Therond
4,931,247 A 6/1990 Yeh
4,963,408 A 10/1990 Huegli
5,048,441 A 9/1991 Quigley
5,057,353 A 10/1991 Maranci et al.
5,131,651 A 7/1992 You
5,301,940 A 4/1994 Seki et al.
5,303,917 A 4/1994 Uke
5,362,046 A 11/1994 Sims
5,364,095 A 11/1994 Easton et al.
5,380,003 A 1/1995 Lanctot
5,395,108 A 3/1995 Souders et al.
5,415,398 A 5/1995 Eggiman
RE35,081 E 11/1995 Quigley
5,490,669 A 2/1996 Smart
5,511,777 A 4/1996 McNeely
5,516,097 A 5/1996 Huddleston
5,556,695 A 9/1996 Mazelsky
5,593,158 A 1/1997 Filice et al.
5,624,115 A 4/1997 Baum
5,641,366 A 6/1997 Hohman
5,676,610 A 10/1997 Bhatt et al.
5,711,728 A 1/1998 Marcelo
5,759,113 A 6/1998 Lai et al.
5,772,541 A 6/1998 Buiatti
5,833,561 A 11/1998 Kennedy et al.
5,899,823 A 5/1999 Eggiman
5,964,673 A 10/1999 MacKay
6,007,439 A 12/1999 MacKay
6,010,417 A 1/2000 Young et al.
6,033,758 A 3/2000 Kocher et al.
6,042,493 A 3/2000 Chauvin et al.
6,053,828 A 4/2000 Pitsenberger
6,265,333 B1 7/2001 Dzenis et al.
6,287,222 B1 9/2001 Pitsenberger
6,344,007 B1 2/2002 Feeney et al.
6,352,485 B1 3/2002 Philpot et al.
6,383,101 B2 5/2002 Eggiman et al.
6,398,675 B1 6/2002 Eggiman et al.
6,425,836 B1 7/2002 Misono et al.
6,440,017 B1 8/2002 Anderson
6,461,260 B1 10/2002 Higginbotham
6,497,631 B1 12/2002 Fritzke et al.
6,508,731 B1 1/2003 Feeney et al.
6,634,969 B2 10/2003 Forsythe
6,663,517 B2 12/2003 Buiatti et al.
6,723,012 B1 4/2004 Sutherland
6,723,127 B2 4/2004 Ralph
6,729,983 B1 5/2004 Vakili et al.
6,755,757 B2 6/2004 Sutherland
6,761,653 B1 7/2004 Higginbotham et al.
6,764,419 B1 7/2004 Giannetti et al.
6,776,735 B1 8/2004 Bélanger et al.
6,808,464 B1 10/2004 Nguyen
6,863,628 B1 3/2005 Bran
6,866,598 B2 3/2005 Giannetti et al.
6,872,156 B2 3/2005 Ogawa et al.
6,997,826 B2 2/2006 Sutherland
7,006,947 B2 2/2006 Tryon, III et al.
7,087,296 B2 8/2006 Porter
7,115,054 B2 10/2006 Giannetti et al.
7,163,475 B2 1/2007 Giannetti
7,344,461 B2 3/2008 Van
7,431,655 B2 10/2008 McCarty et al.
7,442,134 B2 10/2008 Giannetti et al.
7,585,235 B2 9/2009 Misono et al.
7,699,725 B2 4/2010 McNamee et al.
7,749,115 B1 7/2010 Cruz et al.
7,857,719 B2 12/2010 Giannetti et al.
7,867,114 B2 1/2011 Sutherland et al.
7,874,946 B2 1/2011 Smith
7,914,404 B2 3/2011 Giannetti et al.
7,980,970 B2 7/2011 Watari et al.
7,985,149 B2 7/2011 Watari et al.
8,029,391 B2 10/2011 McNamee et al.
8,182,377 B2 5/2012 Chuang et al.
8,197,366 B2 6/2012 Chauvin et al.
8,282,516 B2 10/2012 Chauvin et al.
8,376,881 B2 2/2013 Chuang et al.
8,409,038 B2 4/2013 Macdougall
8,512,174 B2 8/2013 Epling et al.
8,602,924 B2 12/2013 Shindome et al.
8,708,845 B2 4/2014 Chuang et al.
8,814,733 B2 8/2014 Shindome et al.
8,979,682 B2 3/2015 Chuang et al.
9,067,109 B2 6/2015 Goodwin et al.
9,149,697 B2 10/2015 Epling et al.
9,211,460 B2 12/2015 Hayes et al.
9,238,163 B2 1/2016 Hayes et al.
9,427,640 B2 8/2016 Davis et al.
9,744,416 B2 8/2017 Chuang et al.
2001/0014634 A1 8/2001 Mackay, III
2002/0016230 A1 2/2002 Okuyama et al.
2002/0091022 A1 7/2002 Fritzke et al.
2002/0098924 A1 7/2002 Houser et al.
2002/0151392 A1 10/2002 Buiatti et al.
2002/0198071 A1 12/2002 Snow
2003/0153416 A1 8/2003 Anderson
2003/0186763 A1 10/2003 Eggiman et al.
2003/0195066 A1 10/2003 Eggiman et al.
2004/0077439 A1 4/2004 Eggiman et al.
2004/0132563 A1 7/2004 Giannetti et al.
2004/0132564 A1 7/2004 Giannetti et al.
2004/0176197 A1 9/2004 Sutherland
2004/0209716 A1 10/2004 Vacek et al.
2005/0070384 A1 3/2005 Fitzgerald et al.
2005/0070387 A1 3/2005 Miyata et al.
2005/0143203 A1 6/2005 Souders et al.
2005/0227795 A1 10/2005 Fritzke
2006/0025251 A1 2/2006 Giannetti et al.
2006/0247078 A1 11/2006 Giannetti et al.
2006/0247079 A1 11/2006 Sutherland et al.
2007/0202974 A1 8/2007 Giannetti
2007/0205201 A1 9/2007 Cundiff et al.
2007/0219027 A1 9/2007 Chong
2008/0039241 A1 2/2008 Pope et al.
2008/0070726 A1 3/2008 Watari et al.
2009/0065299 A1 3/2009 Vito et al.
2009/0085299 A1 4/2009 Shibayama
2009/0130425 A1 5/2009 Whitaker et al.
2009/0181813 A1 7/2009 Giannetti et al.
2009/0215560 A1 8/2009 Mcnamee et al.
2009/0280935 A1 11/2009 Watari et al.
2010/0160095 A1 6/2010 Chauvin et al.
2011/0165976 A1 7/2011 Chuang et al.
2011/0195808 A1* 8/2011 Chauvin ..... A63B 60/54 473/564
2011/0287875 A1 11/2011 Vander Pol et al.
2012/0142461 A1 6/2012 Chuang et al.
2013/0116070 A1 5/2013 Xun et al.
2013/0165279 A1 6/2013 Chuang et al.
2013/0184108 A1 7/2013 Epling et al.

(56) References Cited

U.S. PATENT DOCUMENTS

| | | | |
|---|---|---|---|
| 2013/0316859 | A1 | 11/2013 | Burger et al. |
| 2014/0080642 | A1 | 3/2014 | Epling et al. |
| 2014/0213395 | A1 | 7/2014 | Chuang et al. |
| 2015/0018139 | A1 | 1/2015 | Slater et al. |
| 2017/0056736 | A1 | 3/2017 | Fitzgerald et al. |
| 2017/0252617 | A1 | 9/2017 | Caron Kardos et al. |
| 2018/0174495 | A1 | 6/2018 | Chauvin et al. |
| 2019/0022483 | A1 | 1/2019 | Chauvin et al. |
| 2019/0054357 | A1 | 2/2019 | Epling et al. |
| 2019/0381377 | A1 | 12/2019 | Chauvin et al. |

FOREIGN PATENT DOCUMENTS

| | | | |
|---|---|---|---|
| CN | 2684892 | Y | 3/2005 |
| EP | 0585965 | A1 | 3/1994 |
| WO | 2004062734 | A2 | 7/2004 |
| WO | 2006015160 | A1 | 2/2006 |
| WO | 2011084847 | A1 | 7/2011 |
| WO | 2013101465 | A1 | 7/2013 |

OTHER PUBLICATIONS

Canadian Intellectual Property, Office, "International Search Report and Written Opinion", for PCT/CA2016/051007, dated Nov. 3, 2016.

Canadian Intellectual Property, Office, "Search Report and Written Opinion", for PCT/CA2016/051007, dated Nov. 3, 2016, 8 pgs.

Fibre Reinforced Plastic, "Sandwich Composite and Core Material Web Page", available at http://www.fibre-reinforced-plastic.com/2010/12/sandwich-composite-and-core-material.html, dated Dec. 12, 2010, website visited Jun. 18, 2018.

Global Plastic Sheeting, "GPS Diamond Scrim", available at https://www.globalplasticsheeting.com/gps-diamond-scrim-30-36-45-lldpe, exact publication date unknown, website visited Dec. 27, 2017.

Global Plastic Sheeting, "Poly Scrim Crawl Space Vapor Barriers", available at https://www.globalplasticsheeting.com/ultra-scrim-crawl-space-vapor-barriers, exact publication date unknown, website visited Dec. 27, 2017, 3 pgs.

IP Australia, "Patent Examination Report No. 1", for AU2012362912, dated Nov. 18, 2016.

Japanese Patent Office, "Office Action", for JP2014-550320, with English translation dated Oct. 25, 2016.

Mustone, et al., "Using LS-DYNA to Develop a Baseball Bat Performance and Design Tool", 6th International LS-DYNA Users Conference, Apr. 9-10, 2000, Detroit, MI.

State Intellectual Property Office, China PRC, "First Office Action", for CN201280064601.8 with English Translation, dated Aug. 18, 2015.

Taiwan Intellectual Property Office, Official Letter and Search Report for TW101148678, with English Translation, dated Jul. 12, 2016.

USPTO, "International Search Report and Written Opinion", for PCT/US2005/026872, dated Dec. 5, 2005.

USPTO, "International Search Report and Written Opinion", for PCT/US2010/062083, dated Apr. 6, 2011.

USPTO, "International Search Report and Written Opinion", for PCT/US2012/069268, dated Apr. 15, 2013.

USPTO, "Non-Final Office Action", for U.S. Appl. No. 14/838,043, dated Feb. 1, 2017.

USPTO, "Final Office Action", for U.S. Appl. No. 14/838,043, dated Feb. 22, 2018.

USPTO, "Non-Final Office Action", for U.S. Appl. No. 15/654,513, dated Sep. 28, 2018.

USPTO, "Non-Final Office Action", for U.S. Appl. No. 15/385,268, dated Jun. 29, 2018.

U.S. Appl. No. 16/012,085, filed Jun. 19, 2018, Chauvin et al.

Canadian IP Office, Office Action for Application No. 2,852,513, dated Oct. 19, 2018.

USPTO, Non-Final Office Action for U.S. Appl. No. 13/337,630, dated Jul. 30, 2013.

USPTO, Non-Final Office Action for U.S. Appl. No. 14/244,566, dated Jun. 18, 2015.

USPTO, Final Office Action for U.S. Appl. No. 14/244,566, dated Dec. 14, 2015.

USPTO, Non-Final Office Action for U.S. Appl. No. 14/244,566, dated May 31, 2016.

USPTO, Final Office Action for U.S. Appl. No. 14/244,566, dated Nov. 23, 2016.

USPTO, Final Office Action for U.S. Appl. No. 15/385,268, dated Feb. 1, 2019.

USPTO, Final Office Action for U.S. Appl. No. 15/654,513, dated Apr. 25, 2019.

USPTO, Non-Final Office Action for U.S. Appl. No. 16/012,085, dated Apr. 2, 2019.

USPTO, "Final Office Action", dated Sep. 27, 2019 for U.S. Appl. No. 16/012,085, 33 pages.

USPTO, "Non-Final Office Action", dated Aug. 20, 2019 for U.S. Appl. No. 15/654,513, 24 pages.

USPTO, "Non-Final Office Action", dated Jul. 5, 2019 for U.S. Appl. No. 15/385,268, 28 pages.

* cited by examiner

BALL BATS WITH REDUCED DURABILITY REGIONS FOR DETERRING ALTERATION

CROSS-REFERENCE TO RELATED APPLICATION

The present application is a continuation-in-part of U.S. patent application Ser. No. 15/654,513, filed Jul. 19, 2017, which is incorporated herein in its entirety by reference.

BACKGROUND

Baseball and softball governing bodies have imposed various bat performance limits over the years with the goal of regulating batted ball speeds. Each association generally independently develops various standards and methods to achieve a desired level of play.

During repeated use of bats made from composite materials, the matrix or resin of the composite material tends to crack and the fibers tend to stretch or break. Sometimes the composite material develops interlaminar failures, which involve plies or layers of composite materials in a composite bat separating or delaminating from each other along a failure plane between the layers. This break-in tends to reduce stiffness and increase the elasticity or trampoline effect of a bat against a ball, which tends to temporarily increase bat performance.

As a bat breaks in, and before it fully fails (for example, before the bat wall experiences a through-thickness failure), it may exceed performance limitations specified by a governing body, such as limitations related to batted ball speed. Some such limitations are specifically aimed at regulating the performance of a bat that has been broken in from normal use (such as BBCOR, or "Bat-Ball Coefficient of Restitution").

Some unscrupulous players choose to intentionally break in composite bats to increase performance. Intentional break-in processes may be referred to as accelerated break-in (ABI) and may include techniques such as "rolling" a bat or otherwise compressing it, or generating hard hits to the bat with an object other than a ball. Such processes tend to be more abusive than break-in during normal use. A rolled or otherwise intentionally broken-in bat may temporarily exceed limitations established by a governing body. Accordingly, unscrupulous users may be able to perform an ABI procedure to increase performance without causing catastrophic failure of the bat that would render it useless.

SUMMARY

Representative embodiments of the present technology include a ball bat with a handle, a barrel attached to or continuous with the handle along a longitudinal axis of the bat, and a reduced-durability region positioned in the barrel. The reduced-durability region may include two adjacent stacks of composite laminate plies, wherein the stacks are spaced apart from each other along the longitudinal axis to form a first gap therebetween. A separation ply may be positioned in the first gap between the stacks. In some embodiments, the separation ply may include a composite fiber mat. In some embodiments, the separation ply may include a release ply. In some embodiments, the separation ply includes a non-woven fiber mat material. At least one cap ply element may be positioned around an end of one of the stacks. In some embodiments, an axis of the first gap is oriented at an oblique angle relative to the longitudinal axis of the bat. In some embodiments, at least one of the stacks includes one or more fibrous bundles, the one or more fibrous bundles being oriented transverse to the at least one of the stacks and extending at least partially circumferentially about the barrel.

The barrel may further include an outwardly facing skin facing away from the barrel and an inwardly facing skin facing an interior hollow region of the barrel. At least one of the outwardly facing skin or the inwardly facing skin may include a discontinuity forming a second gap in the at least one of the outwardly facing skin or the inwardly facing skin along the longitudinal axis, the first gap and the second gap being connected to each other. A cover layer may be positioned over the second gap. The cover layer may include carbon fiber composite.

In some embodiments, a ring element may be positioned in a gap between the stacks. The ring element may include a rigid or semi-rigid material. A first bond between the ring element and adjacent composite matrix material may be weaker than a second bond between the composite laminate plies in each of the stacks. In some embodiments, the ring element may have a rectangular or otherwise elongated cross-section that is oriented perpendicular to the longitudinal axis of the ball bat. In some embodiments, the ring element may have a cross-section that is oriented at an oblique angle relative to the longitudinal axis. In some embodiments, the ring element may have a triangular cross-section, a square cross-section, or other cross-sectional shapes.

The reduced-durability region may include one or more composite laminate plies positioned between the ring element and at least one of an outwardly facing skin or an inwardly facing skin of the ball bat. In some embodiments, the reduced-durability region may further include a second ring element, which may be spaced apart from the first ring element, with a composite laminate ply therebetween, or the second ring element may be attached to the first ring element. In some embodiments, the second ring element may be attached to the first ring element with a bond or other connection that is configured to fail under a stress that is less than a stress that would cause failure of a bond between composite laminate plies in the stacks.

Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

The present technology is directed to ball bats with reduced-durability regions for deterring alteration, and associated systems and methods. Various embodiments of the technology will now be described. The following description provides specific details for a thorough understanding and enabling description of these embodiments. One skilled in the art will understand, however, that the invention may be practiced without many of these details. Additionally, some well-known structures or functions, such as structures or functions common to ball bats and composite materials, may not be shown or described in detail so as to avoid unnecessarily obscuring the relevant description of the various embodiments. Accordingly, embodiments of the present technology may include additional elements or exclude some of the elements described below with reference to FIGS. 1-19, which illustrate examples of the technology.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Specific details of several embodiments of the present technology are described herein with reference to baseball or softball. The technology may also be used in other sporting good implements or in other sports or industries in which it may be desirable to discourage tampering, damage, or overuse in composites or other structures. Conventional aspects of ball bats and composite materials may be described in reduced detail herein for efficiency and to avoid obscuring the present disclosure of the technology. In various embodiments, a number of different composite materials suitable for use in ball bats may be used, including, for example, composites formed from carbon fiber, fiberglass, aramid fibers, or other composite materials or combinations of matrices, resins, fibers, laminates, and meshes forming composite materials.

Figure 1:
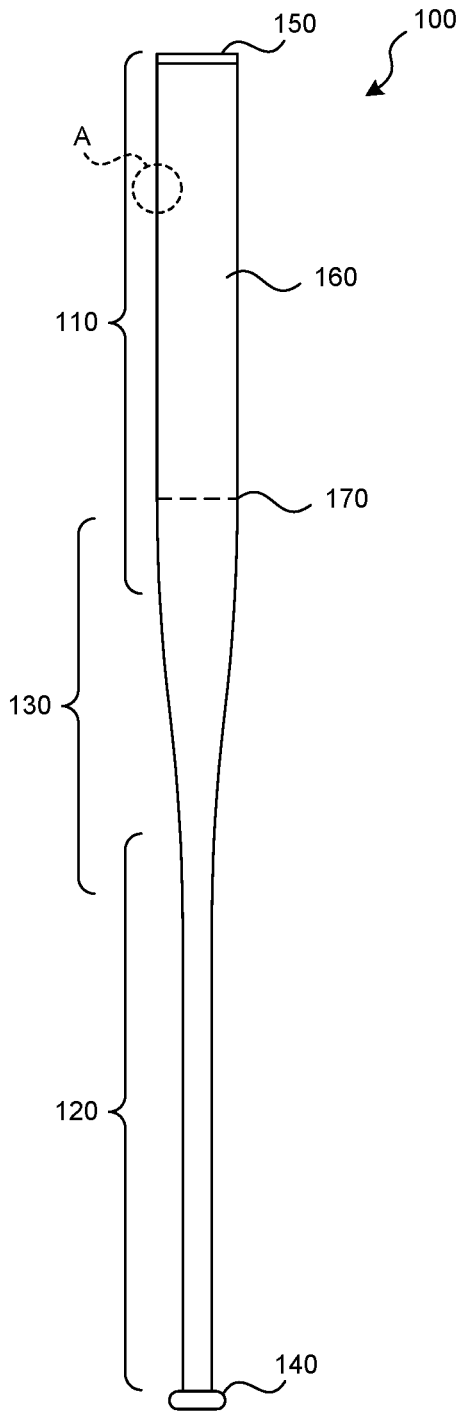
FIG. 1 illustrates a ball bat according to an embodiment of the present technology.

Turning now to the drawings, FIG. 1 illustrates a ball bat 100 having a barrel portion 110 and a handle portion 120. There may be a transitional or taper portion 130 in which a larger diameter of the barrel portion 110 transitions to a narrower diameter of the handle portion 120. The handle portion 120 may include an end knob 140 and the barrel portion 110 may optionally be closed with an end cap 150. The barrel portion 110 may include a non-tapered or straight section 160 extending between the end cap 150 and an end location 170.

The bat 100 may have any suitable dimensions. For example, the bat 100 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 100, and may vary greatly among users.

The barrel portion 110 may be constructed with one or more composite materials. Some examples of suitable composite materials include plies reinforced with fibers of carbon, glass, graphite, boron, aramid (such as Kevlar®), ceramic, or silica (such as Astroquartz®). The handle portion 120 may be constructed from the same materials as, or different materials than, the barrel portion 110. In a two-piece ball bat, for example, the handle portion 120 may be constructed from a composite material (the same or a different material than that used to construct the barrel portion 110), a metal material, or any other material suitable for use in a striking implement such as the bat 100.

FIGS. 2-8, 10-16, and 18 illustrate partial cross-sectional views of a portion of the straight section 160 of the bat barrel 110 according to embodiments of the present technology. Each of FIGS. 2-8, 10-16, and 18 illustrates a two-dimensional projection of a cross-section of a wall of the barrel between an interior portion of the bat and the exterior of the bat. For example, FIGS. 2-8, 10-16, and 18 may illustrate a part of the bat 100 in section A indicated in FIG. 1, or they may illustrate other sections.

Figure 2:
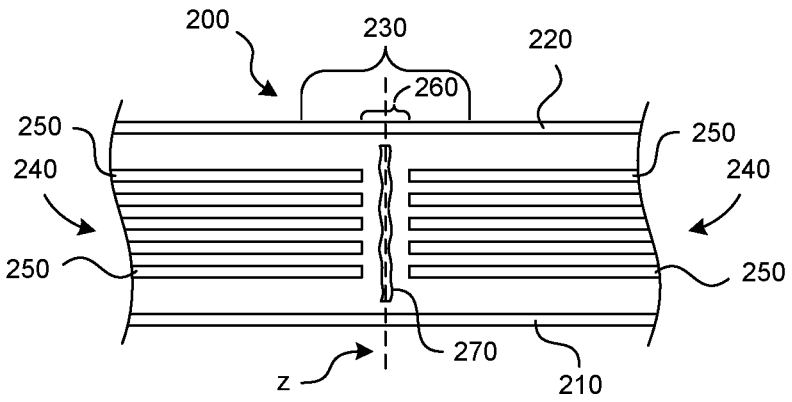
FIG. 2 illustrates a partial cross-sectional view of a portion of a barrel wall having a reduced-durability region according to an embodiment of the present technology.

FIG. 2 illustrates a partial cross-sectional view of a portion of a composite barrel wall 200 in the straight section 160 of the bat 100 according to an embodiment of the present technology. The wall 200 defines an outer structure of the bat 100, which may be hollow in some embodiments. The wall 200 may have an inwardly facing skin 210 positioned to face toward an interior area of the bat 100, and an outwardly facing skin 220 positioned to face outwardly from the bat 100. In some embodiments, the bat 100 may include interior structural elements within the composite wall 200 or elsewhere in the bat 100. The composite barrel wall 200 may be formed from a variety of materials such as the composite materials described herein. For example, the inwardly facing skin 210 or the outwardly facing skin 220 may be formed with a composite material including carbon fibers oriented at approximately 60 degrees relative to the longitudinal axis of the bat 100. Any other suitable fibrous materials and fiber angles may be used.

A reduced-durability region 230 may include two or more stacks 240 of plies 250 of laminate materials positioned on each side of a discontinuity or gap region 260 inside the wall 200. Although the gap region 260 is described as being located between two or more stacks 240, the gap region 260 may also be considered a discontinuity in what would otherwise be a continuous single stack 240 of plies 250. Although five plies 250 are illustrated in each stack 240, any suitable number of plies 250 may form each stack 240, and the stacks 240 may have different quantities of plies 250 from each other. In various embodiments, the plies 250 forming the stacks 240 may be formed from any material or materials suitable for use in ball bats, striking implements, or other equipment, including, for example, carbon fiber in a matrix, glass fiber in a matrix, aramid fibers in a matrix, or other composite materials or combinations of matrices, resins, fibers, or meshes forming composite laminate layers, including other composite materials described herein. The plies 250, the outwardly facing skin 220, and the inwardly facing skin 210 may be formed from pre-impregnated material cured in a mold. In some embodiments, resin transfer molding processes may be used to form the various layers of embodiments of the technology.

In a conventional bat that does not include a gap region 260 (in other words, in a bat with a continuous stack of plies), stresses in the bat wall would generally be distributed along the length of the plies (generally along a longitudinal axis of the bat). In such a conventional bat, forces from impact or other stresses would generally cause the plies to delaminate from each other. The gap region 260 focuses or directs the stress concentration between the stacks 240, thereby creating a new failure plane in addition to existing failure modes, such as delamination. For example, when a bat is rolled or otherwise tampered with, or when a bat has been overly broken in or overused, the wall 200 may break through and along the gap region 260, such as along the Z-axis (labeled "z") of the bat wall 200 or otherwise along a path between the inwardly facing skin 210 and the outwardly facing skin 220. Such a break may cause the wall 200 to fail (destroying the bat) before significant delamination occurs that would otherwise improve performance (including performance that may violate league or organization rules or is otherwise undesirable). In other words, the gap region 260 weakens the strength of the wall 200 along the Z-axis such that it is weaker than the axial (along the longitudinal axis of the bat) interlaminar strength.

In some bats with gaps or discontinuities between stacks of plies, the gap may be too strong or too narrow to reliably provide such a break after overuse or abuse. In other words, in some bats with gap regions that are too strong, delamination may occur to a significant (or undesirable) degree before a break in the gap region causes total failure of the wall. For example, during the molding process for a composite bat with a gap (such as the gap region 260), plies (such as the plies 250) may move, narrowing or even closing the gap, which may delay or disrupt the failure along the gap. According to embodiments of the present technology, to prevent such movement and to lower the energy needed to trigger the thickness failure along the gap region 260 to a level at which the thickness failure occurs before the plies 250 in the stacks 240 delaminate, an appliance such as a separation ply 270 may be positioned in the gap region 260.

The appliance, such as the separation ply 270, also reduces or prevents interweaving, nesting, or bonding of the stacks 240 across the gap region 260, thereby resisting or preventing an undesirable increase in strength at the gap region 260 relative to a gap without such a separation ply 270. For example, if the separation ply 270 allows some bonding between the stacks 240, the gap region 260 may be stronger. If the separation ply 270 is a barrier, it may allow only minimal bonding or no bonding at all across the gap region 260, resulting in a weaker gap region 260. By managing the strength of the wall 200 at the gap region 260, the level of energy at which failure of the wall 200 occurs at the gap region 260 can be tailored to be lower than the energy required to delaminate the stacks 240 in a particular bat configuration.

The separation ply 270 may be formed from any suitable material, depending on the level of bonding desired between the stacks 240. For example, in a heavier bat or in a bat with a relatively high moment of inertia (for example, near or above 6000 ounce-square inch), in which a strong gap region 260 is desired, a strong material may be used, such as one or more carbon fiber or glass fiber composite mats or other fiber composite mats. In some embodiments, the separation ply 270 may be rigid or semi-rigid, while in other embodiments it may be flexible. In a lighter bat or in a bat with a relatively low moment of inertia (for example, near or below 6000 ounce-square inch), in which a gap region 260 may not need to be as strong, a release ply material, such as polytetrafluoroethylene (PTFE, commercially available as TEFLON), nylon sheet, or other release plies may be used. In some embodiments, the release ply material may be perforated or porous, which may increase the strength of the gap region 260 by allowing limited bonding between the stacks 240.

In a particular representative embodiment, the separation ply 270 may be formed from a non-woven mat material having a fiber aerial weight of approximately 30 grams per square meter. Such a material may include a variety of types of fibers and treatments and may function as an inexpensive and reliable material for providing a desired strength in the gap region 260.

The reduced-durability region 230 (centered around the middle of the gap region 260) may be located along the straight section 160 of the bat barrel 110 (see FIG. 1). For example, with reference to FIG. 1, in some embodiments, the reduced-durability region 230 may be located within section A, or it may be located anywhere between approximately one inch from the distal end of the bat 100 having end cap 150 and approximately one inch from the end location 170 of the straight section 160. In other embodiments, the reduced-durability region 230 may be located in other portions of the bat 100. In general, the reduced-durability region 230 may be positioned anywhere a bat may be rolled or tampered with by a user, or anywhere a regulatory body wishes to test the bat 100. In some embodiments, the reduced-durability region 230 may be positioned at or near the center of percussion of the bat 100, as measured by the ASTM F2398-11 Standard. In some embodiments, the reduced-durability region 230 may be positioned somewhere between the center of percussion and the end location 170 of the straight section 160.

Figure 3:
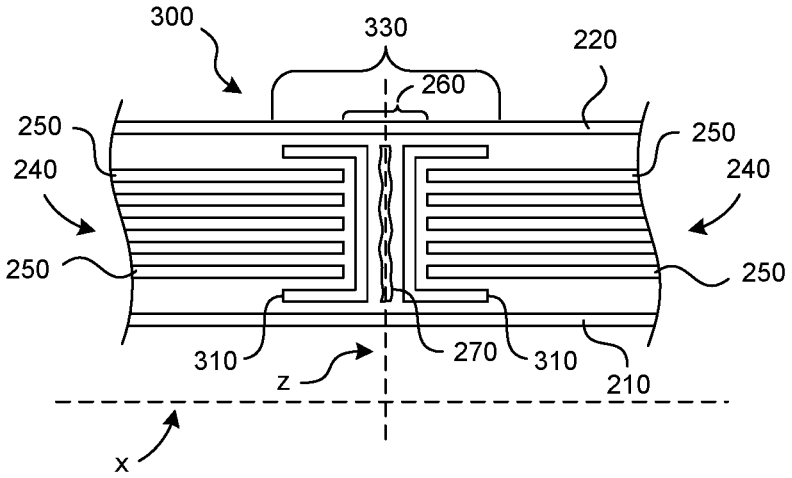
FIG. 3 illustrates a partial cross-sectional view of a portion of a barrel wall having a reduced-durability region according to another embodiment of the present technology.

FIG. 3 illustrates a partial cross-sectional view of a portion of a composite barrel wall 300 in the straight section 160 of the bat 100 having a reduced-durability region 330 according to another embodiment of the present technology. The wall 300 illustrated in FIG. 3 may be generally similar to the wall 200 illustrated and described above with regard to FIG. 2, but it may further include one or more cap ply elements 310, which are described in additional detail below. For example, the barrel wall 300 may include an inwardly facing skin 210, an outwardly facing skin 220, stacks 240 of plies 250 on either side of a gap region 260, and a separation ply 270 to reduce or prevent bonding across the gap region 260.

When a crack forms in the gap region 260, the cap ply elements 310 prevent (or at least resist) proliferation of the crack to the stacks 240 of plies 250. In other words, the cap ply elements 310 prevent or resist delamination of the stacks 240 of plies 250 by preventing or resisting spreading of the crack along the axial length of the bat (i.e., along the longitudinal or x-axis of the bat, marked with "x" in FIG. 3). Thus, when a crack forms it will be generally directed along the z-axis through the gap region 260 or otherwise along the gap region 260 between the inwardly facing skin 210 and the outwardly facing skin 220, as described above.

The cap ply elements 310 may be formed from a foam material, a plastic material, or another material suitable for being folded, molded, or otherwise shaped around an edge of each of the stacks 240. In some embodiments, the cap ply elements 310 may be formed from similar materials as the separation ply 260. In some embodiments, the cap ply elements 310 may be rigid. In other embodiments, the cap ply elements 310 may be flexible (for example, they may be formed with an elastomer material to make the cap ply elements 310 resilient). Because FIG. 3 illustrates a cross-section, it is understood that each cap ply element 310 may be in the form of a ring positioned along the circumference of an assembled bat.

Figure 4:
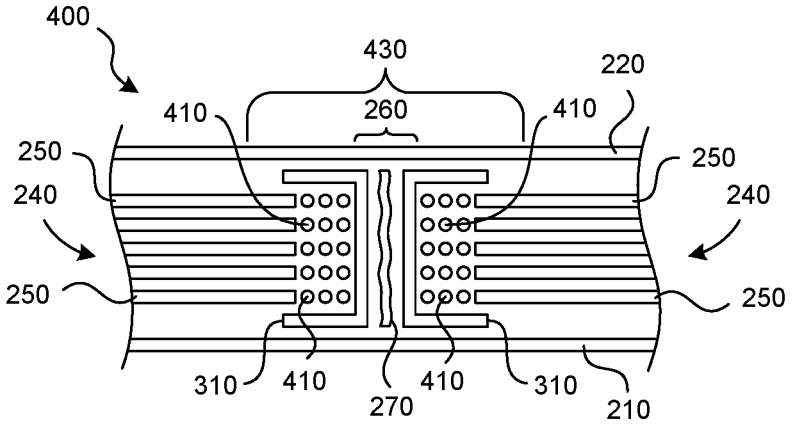
FIG. 4 illustrates a partial cross-sectional view of a portion of a barrel wall having a reduced-durability region according to another embodiment of the present technology.

FIG. 4 illustrates a partial cross-sectional view of a portion of a composite barrel wall 400 in the straight section 160 of the bat 100 having a reduced-durability region 430 according to another embodiment of the present technology. The wall 400 illustrated in FIG. 4 may be generally similar to the wall 300 illustrated and described above with regard to FIG. 3. In addition, the stacks 240 of plies 250 may also include one or more circumferential fibers or fibrous bundles 410 positioned at the end of the stacks 240 between the stacks 240 and the cap ply elements 310. The fibrous bundles 410 may be oriented to be generally transverse (such as perpendicular) to the plies 250, for example, they may be positioned circumferentially through the interior of the barrel wall 400 around at least a portion of the bat. The fibrous bundles 410 increase local stiffness in the vicinity of the gap region 260 to help guide the failure of the wall 400 through the gap region 260. Although the fibrous bundles 410 are illustrated as being adjacent to the cap ply elements 310 in FIG. 4, in some embodiments, they may be positioned in other locations.

Figure 5:
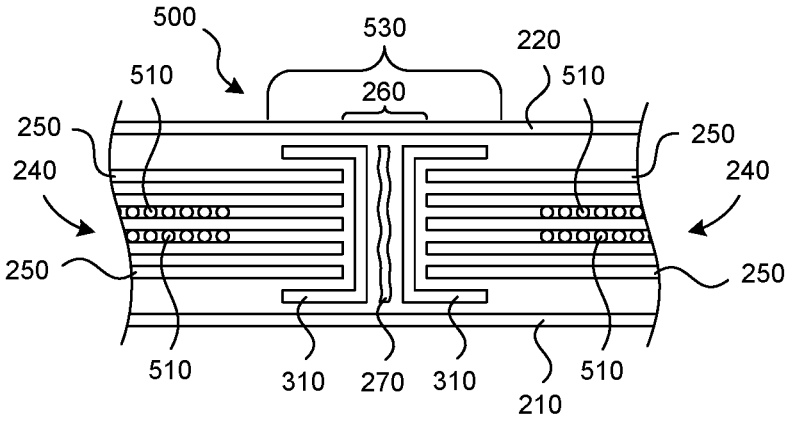
FIG. 5 illustrates a partial cross-sectional view of a portion of a barrel wall having a reduced-durability region according to another embodiment of the present technology.

For example, FIG. 5 illustrates a partial cross-sectional view of a portion of a composite barrel wall 500 in the straight section 160 of the bat 100 having a reduced-durability region 530 according to another embodiment of the present technology. The wall 500 illustrated in FIG. 5 may be generally similar to the wall 300 illustrated and described above with regard to FIG. 3. In addition, the stacks 240 of plies 250 may also include one or more circumferential fibers 510 positioned between plies 250 in the stacks 240. For example, there may be a plurality of circumferential fibers or fibrous bundles 510 sandwiched between two or more plies 250. The fibrous bundles 510 may be oriented transverse (such as perpendicular) to the plies 250, for example, they may be positioned circumferentially through the interior of the wall 500 around at least a portion of the bat. The fibrous bundles 510 increase local stiffness of the barrel at a distance from the gap region 260 to further customize the strength of the gap region 260 or to further concentrate stresses in the gap region 260. In some embodiments, one or more of the fibrous bundles 510 may be positioned at a distance of approximately 1 to 2 inches from the reduced-durability region 530.

Figure 6:
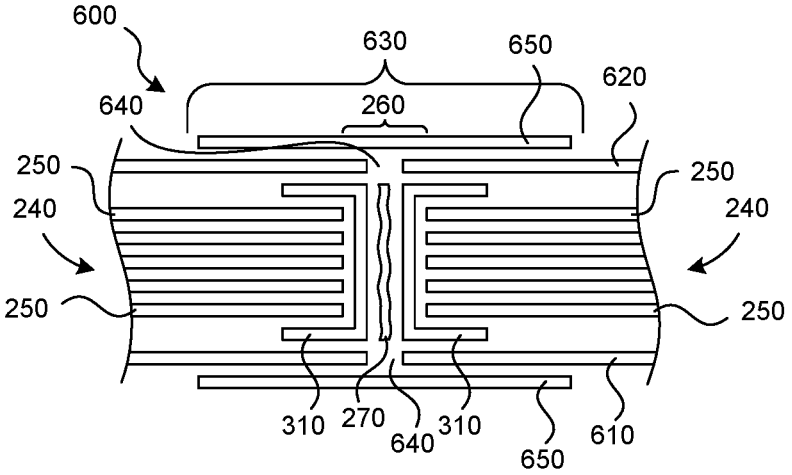
FIG. 6 illustrates a partial cross-sectional view of a portion of a barrel wall having a reduced-durability region according to another embodiment of the present technology.

FIG. 6 illustrates a partial cross-sectional view of a portion of a composite barrel wall 600 in the straight section 160 of the bat 100 having a reduced-durability region 630 according to another embodiment of the present technology. The wall 600 illustrated in FIG. 6 may be generally similar to the wall 300 illustrated and described above with regard to FIG. 3, but the gap region 260 extends through at least one of the inwardly facing skin 610 and the outwardly facing skin 620. For example, one or both of the inwardly facing skin 610 or the outwardly facing skin 620 may have a gap or discontinuity 640 that extends the gap region 260 through one or both of the inwardly facing skin 610 or the outwardly facing skin 620. The discontinuity 640 in the inwardly facing skin 610 or the outwardly facing skin 620 may be aligned with the gap region 260. A cover layer 650 may be positioned to cover the gap region 260 and the discontinuity 640.

Although two cover layers 650 are illustrated, in some embodiments with only one discontinuity 640, only one cover layer 650 may be used. The cover layers 650 may be formed with intermediate modulus carbon fiber composite (which may have a Young's Modulus or elastic modulus between approximately 42 million pounds per square inch and 55 million pounds per square inch) or another composite or non-composite material suitable for allowing through-failure of the bat wall 600 before significant delamination occurs in the stacks 240 of plies 250. Intermediate modulus carbon fiber materials may be beneficial because they generally provide more stiffness per unit weight than standard carbon fiber materials (which may have elastic modulus values around 33 million pounds per square inch). Intermediate modulus materials provide more stiffness than standard fiber materials while generally being less costly and less brittle than higher modulus fiber materials (which have elastic modulus values greater than 55 million pounds per square inch). The embodiment of the wall 600 and the reduced-durability region 630 illustrated and described with regard to FIG. 6 allows for further customization of the strength of the reduced-durability region 630 and the gap region 260.

Figure 7:
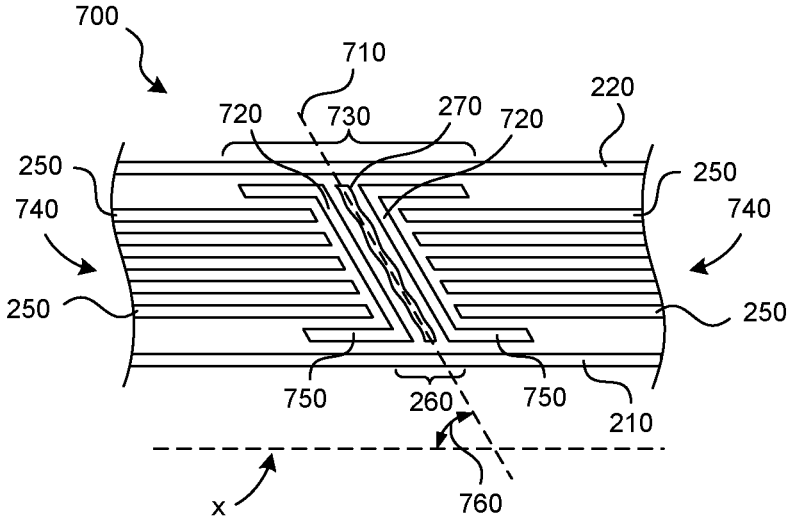
FIG. 7 illustrates a partial cross-sectional view of a portion of a barrel wall having a reduced-durability region according to another embodiment of the present technology.

FIG. 7 illustrates a partial cross-sectional view of a portion of a composite barrel wall 700 in the straight section 160 of the bat 100 having a reduced-durability region 730 in accordance with another embodiment of the present technology. The wall 700 illustrated in FIG. 7 may be generally similar to the wall 300 illustrated and described above with regard to FIG. 3, but the gap region 260 is oriented at an oblique angle. For example, an axis 710 of the gap region 260 (parallel to the transverse portions 720 of the cap ply elements 750 abutting the stacks 740) may be oriented at an angle 760 relative to the longitudinal or X-axis (labeled "x") of the bat. The angle 760 may have a value of between 1 and 89 degrees, for example, it may be between 30 and 65 degrees, or 60 degrees in a particular embodiment. The stacks 740, having plies 250, may be staggered or angled to correspond to the angle 760 of the gap region 260. The separation ply 270 may also be angled to correspond to the angle 760 of the gap region 260. Likewise, the cap ply elements 750, which may be similar to the cap ply elements 310 described above, may have transverse portions 720 that are also oriented along the angle 760.

In some embodiments, when the angle 760 is relatively small, the wall 700 and the reduced-durability region 730 increase in strength. For example, the wall 700 and the reduced-durability region 730 may withstand more forces before experiencing a through-failure in the gap region 260.

As described above, the separation ply 270 may cause failure to propagate through the wall of a bat (e.g., through the stacks 240) along the Z-axis within or along the gap regions 260 faster than failure occurring in bats without reduced durability regions (such as those without gap regions 260). In other embodiments of the present technology, other appliances may provide similar effects. FIGS.

8-19 illustrate embodiments with other appliances to control failure along the Z-axis through the bat wall. In some embodiments, rigid or semi-rigid appliances, such as those described below, may reduce the risk that interlaminar failures (which can cause undesirable increases in performance) occur before a bat fails through its wall along the Z-axis. Such rigid or semi-rigid appliances may improve control and consistency of the strength properties of a bat wall.

Figure 8:
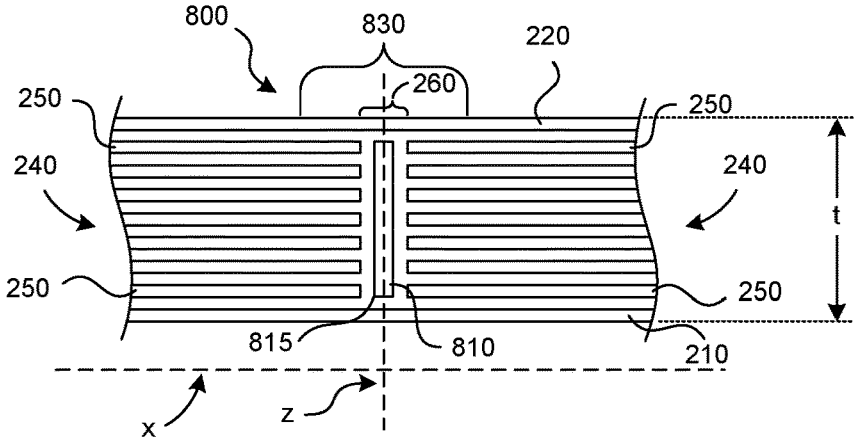
FIGS. 8, 10-16, 18 and 20 illustrate partial cross-sectional views of portions of barrel walls having reduced-durability regions according to other embodiments of the present technology.
Figure 9:
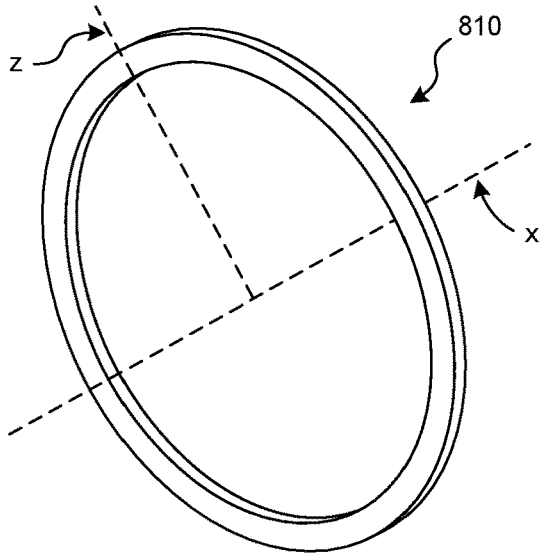
FIGS. 9 and 19 illustrate isometric views of appliances in the form of ring elements according to embodiments of the present technology.

FIG. 8 illustrates a partial cross-sectional view of a portion of a composite barrel wall 800 in the straight section 160 of the bat 100 having a reduced-durability region 830 according to another embodiment of the present technology. The wall 800 illustrated in FIG. 8 may be generally similar to the wall 200 illustrated and described above with regard to FIG. 2, but instead of using a separation ply 270 to guide failure through the bat wall, the appliance positioned in the gap region 260 may be a ring element 810 (see FIG. 9). The ring element 810 functions similarly to the separation ply 270 in that it reduces or prevents bonding across the gap region 260 and guides failure through the bat wall along the Z-axis. The ring element 810, however, facilitates a more predictable fracture location and a more predictable level of strain at which failure may occur. The ring element 810 may be formed as a single piece or as multiple pieces connected together, with or without discontinuities along its circumference. In some embodiments, the ring element 810 may have a rectangular or otherwise elongated cross-section 815 that is oriented along the Z-axis, perpendicular to the longitudinal axis of the bat (the X-axis), such that the ring element 810 traverses across the stacks 240 in a direction perpendicular to the plies 250. In other embodiments, the ring element 810 need not be oriented perpendicular to the longitudinal axis of the bat, and it may have other orientations (for example, see below with regard to FIG. 10). In some embodiments, the cross-section 815 may be square-shaped, or it may have other suitable shapes.

When a crack forms in the gap region 260, the ring element 810 prevents (or at least resists) proliferation of the crack to the stacks 240 of plies 250. In other words, the ring element 810 prevents or resists delamination of the stacks 240 of plies 250 by preventing or resisting spreading of the crack along the axial length of the bat (i.e., along the longitudinal or X-axis of the bat, marked with "x" in FIG. 8). Thus, when a crack forms it will be generally directed along the Z-axis through the gap region 260 or otherwise along the gap region 260 between the inwardly facing skin 210 and the outwardly facing skin 220.

Appliances may have a variety of shapes. The size, shape, and dimensions of the ring element 810 and other appliances described below may be adjusted to meet the desired overall strength of the bat in normal use and during ABI processes, the bond strength between the composite resin or matrix and the appliance (such as the ring element 810), and the strength of the appliance itself (such as the ring element 810).

For example, rigid or semi-rigid appliances may be formed with a high-surface-energy material such as acetal polymer (for example, Delrin®), polytetrafluoroethylene (PTFE, for example, Teflon®), polyoxymethylene (POM), polyamides (Nylon), polyethylene terephthalate (PET), or other suitable plastic or polymer materials. Such high-surface-energy materials resist or even prevent bonding between the composite matrix and the appliance. A weak or nonexistent bond between the composite matrix and the appliance facilitates rapid and predictable failure of the bond. In embodiments of the present technology that implement a high-surface-energy material or another material that provides a weak or nonexistent bond between the composite matrix and the appliance, the inwardly facing skin 210 and the outwardly facing skin 220 may be constructed to be sufficiently strong to handle the stress of normal use, but sufficiently weak to fail during ABI processes. In some embodiments, one or more plies 250 may not include a discontinuity or gap and may further strengthen the reduced-durability region (as described below, for example, with regard to FIG. 11). For example, an appliance may traverse approximately 25% of the wall thickness t, or other fractions thereof.

In some embodiments, appliances may be formed with materials having moderate to strong bond strength with the surrounding composite matrix material in the bat wall. Such materials may provide further control of how much strain is required to cause the bat wall to fracture. Materials that may provide moderate to strong bond strength with the composite matrix material (which may be epoxy or polyurethane resin, for example) include acrylonitrile butadiene styrene (ABS), polyvinyl chloride (PVC), polycarbonate (PC), polyurethane (PU). Other materials may provide moderate to strong bond strength with the composite matrix material.

In some embodiments, appliances described herein may be formed from a breakable material such that the appliances themselves fracture before delamination occurs. In some embodiments, some appliances may be scored or etched to force a failure or breaking point. In some embodiments, appliances may be made by a method that provides inherent flaws, such as a 3D printing process. In a particular embodiment, ABS material provides a balance between the strength of the bond with the composite matrix material and the strength of the appliance itself. In some embodiments, an appliance made with ABS material may be weaker than the interlaminar bond between the composite plies 250.

In yet other embodiments, appliances may be formed with metal, such as aluminum, steel, or titanium, or other metals, foam materials, or wood, or any other suitable rigid or semi-rigid material. In general, a designer may select the appropriate material for the appliance based on the strength of a bond between the material and the composite matrix, or based on the strength of the material itself.

In some embodiments, appliances may be formed with composite material (such as composite laminate material, bulk molding compound, or sheet molding compound). In some embodiments, a composite appliance may be pre-formed with composite material and pre-cured, then installed in a ball bat composite layup during manufacturing. In some embodiments in which appliances are formed with composite materials, the strength or stiffness of the appliances may be selected or designed to match or exceed the strength or stiffness of the composite material located next to the appliance in the gap. In some embodiments, because the appliances may be pre-cured, they may have a reduced bond strength with neighboring composite material in the bat wall relative to composites that are cured simultaneously. Accordingly, the bond strength of a pre-cured composite appliance may be lower than the interlaminar strength between composite laminate plies 250. For example, the bond strength of a pre-cured composite appliance may be only approximately 75 to 80 percent of the bond strength of plies 250, which facilitates failure along the sides or within the appliance at lower stress levels than those that may cause interlaminar failure.

Figure 10:
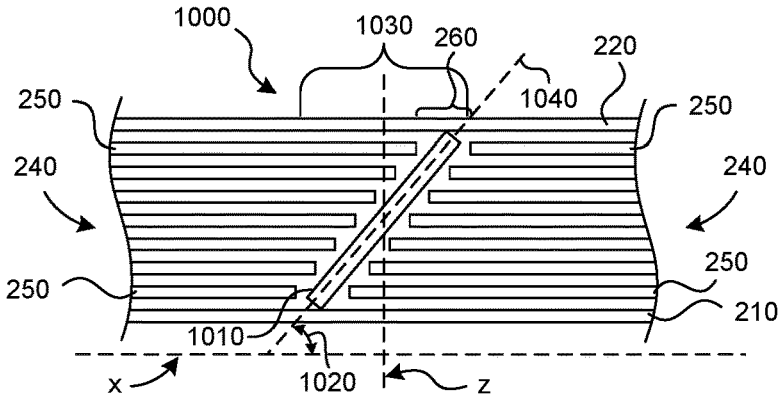

FIG. 10 illustrates a partial cross-sectional view of a portion of a composite barrel wall 1000 in the straight section 160 of the bat 100 having a reduced-durability region 1030 according to another embodiment of the present technology. The wall 1000 illustrated in FIG. 10 may be generally similar to the wall 800 illustrated and described above with regard to FIG. 8, but the appliance may be in the form of a beveled ring element 1010. The beveled ring element 1010 may resemble the ring element 810, but it may have a cross-section that traverses an angled gap region 260, or is otherwise oriented at an oblique angle relative to the stacks 240 of plies 250. For example, a cross-section of the beveled ring element 1010 may have an axis 1040 that is oriented at an angle 1020 (such as an oblique angle) relative to the longitudinal or X-axis of the bat, or to the plies 250. The angle 1020 may have a value between 30 degrees and 90 degrees (for example, 45 degrees). The stacks 240, having plies 250, may be staggered or angled to correspond to the angle 1020 of the beveled ring element 1010.

The beveled ring element 1010 functions generally similarly to the flat ring element 810 described above with regard to FIG. 8, but the angle 1020 facilitates additional modification of the fracture properties of the wall 1000. In some embodiments, when the angle 1020 is relatively small, the wall 1000 and the reduced-durability region 1030 increase in strength. For example, the wall 1000 and the reduced-durability region 1030 may withstand more forces before experiencing a through-failure in the gap region 260 than would a flat ring element 810 (FIG. 8), depending on the materials forming the appliance and the bond strength between the appliance and the composite matrix in the wall. The beveled ring element 1010 may be formed as a single piece or as multiple pieces connected together, with or without discontinuities along its circumference.

Figure 11:
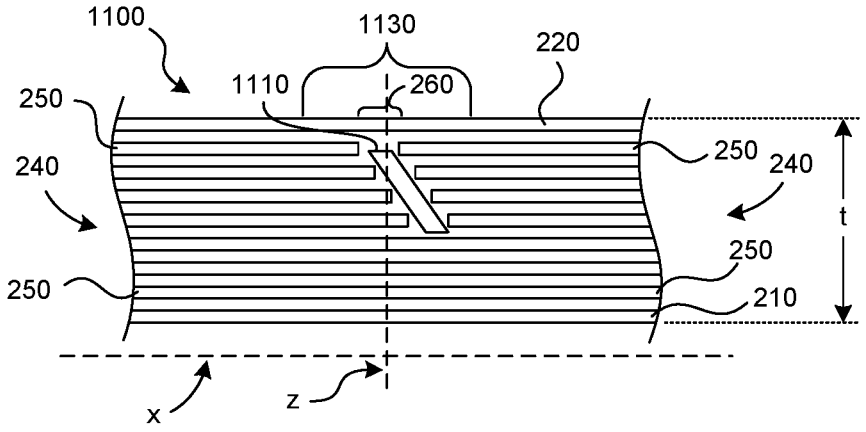

FIG. 11 illustrates a partial cross-sectional view of a portion of a composite barrel wall 1100 in the straight section 160 of the bat 100 having a reduced-durability region 1130 according to another embodiment of the present technology. The reduced-durability region 1130 in FIG. 11 is generally similar to the reduced-durability region 1030 described and illustrated above with regard to FIG. 10, except that the appliance may be in the form of a beveled ring element 1110 that extends through only a portion of the stacks 240 of plies 250. For example, the gap region 260 between the stacks 240 may not extend through all the plies 250, such that one or more plies 250 are continuous in the reduced-durability region 1130. In other words, the beveled ring element 1110 may occupy between 25 percent and 50 percent of the overall thickness t of the barrel wall 1100. The plies 250 that are continuous (not interrupted by a gap or an appliance) may be referred to as through-plies. Any suitable number of through-plies may be positioned in the wall 1100, toward the outwardly facing skin 220 (such as one or more through-plies between the ring element 1110 and the outwardly facing skin 220) or toward the inwardly facing skin 210 (such as one or more through-plies between the ring element 1110 and the inwardly facing skin 210).

Figure 12:
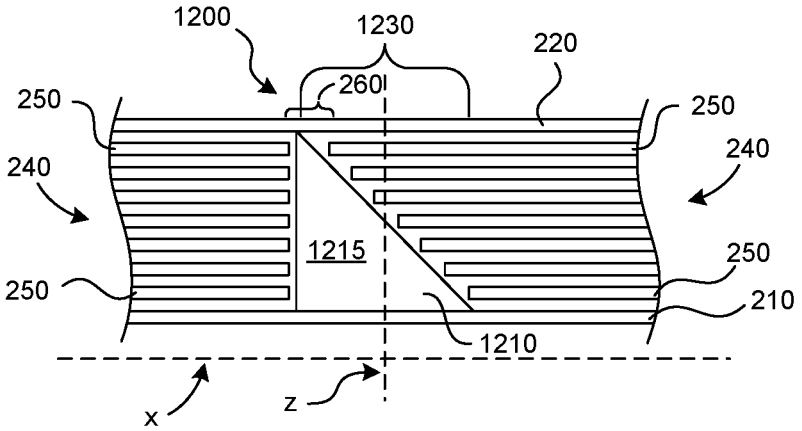

FIG. 12 illustrates a partial cross-sectional view of a portion of a composite barrel wall 1200 in the straight section 160 of the bat 100 having a reduced-durability region 1230 according to another embodiment of the present technology. The reduced-durability region 1230 in FIG. 12 is generally similar to the other reduced-durability regions described herein, except that the appliance may be in the form of a ring element 1210 with a triangular cross-section 1215. The triangular cross-section 1215 may have any suitable dimensions. For example, it may be sized to fully or almost fully extend between the inwardly facing skin 210 and the outwardly facing skin 220. The ring element 1210 may be sized to allow plies 250 (such as through-plies) to pass between the ring element 1210 and the inwardly facing skin 210 or the outwardly facing skin 220. The triangular cross-section 1215 may have equilateral proportions, isosceles proportions, scalene proportions, or other proportions. The triangular cross-section 1215 may include any suitable angles, such as a right angle. Although the triangular cross-section 1215 is illustrated as having one side that is parallel with the X-axis of the bat, in various embodiments, the triangular cross-section 1215 may have other orientations.

Figure 13:
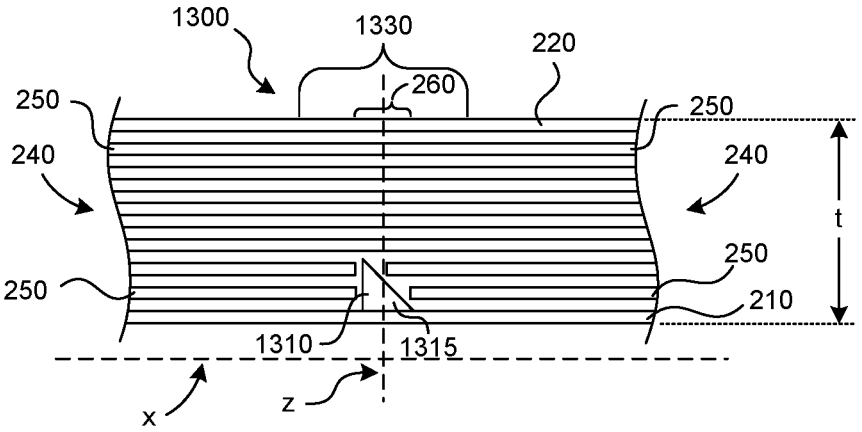

FIG. 13 illustrates a partial cross-sectional view of a portion of a composite barrel wall 1300 in the straight section 160 of the bat 100 having a reduced-durability region 1330 according to another embodiment of the present technology. The reduced-durability region 1330 in FIG. 13 is generally similar to the other reduced-durability regions described herein, including the reduced-durability region 1230 illustrated in FIG. 12 and described above. In some embodiments, the appliance may be in the form of a ring element 1310 that is similar to the ring element 1210 illustrated and described above with regard to FIG. 12, but with a triangular cross-section 1315 that is smaller than the cross-section 1215 illustrated in FIG. 12. For example, the triangular cross-section 1315 may span approximately 25% of the overall wall thickness t of the barrel wall 1300. In some embodiments, the triangular cross-section 1315 may be positioned adjacent to one of the skins 210, 220, or there may be one or more through-plies 250 between the inwardly facing skin 210 and the triangular cross-section 1315 or between the outwardly facing skin 220 and the triangular cross-section 1315. In some embodiments, the triangular cross-section 1315 may be positioned in a gap region 260 that includes gaps between any suitable number of composite laminate plies 250 (for example, as shown in the illustration in FIG. 13, two plies 250 may have gaps within which the ring element 1310 is situated).

Figure 14:
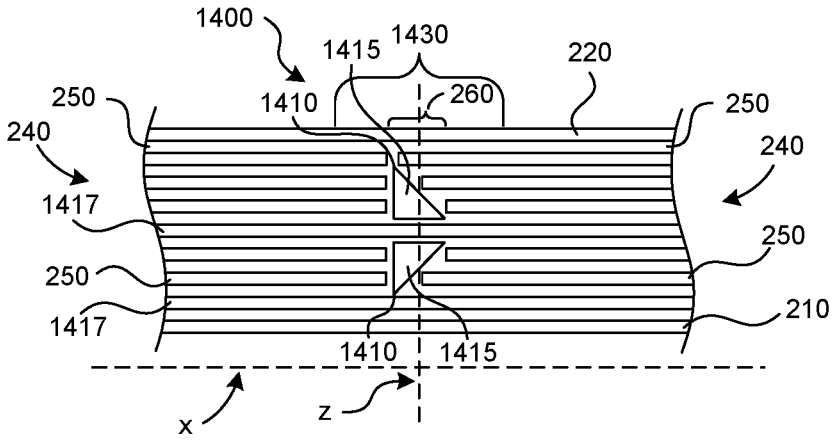

FIG. 14 illustrates a partial cross-sectional view of a portion of a composite barrel wall 1400 in the straight section 160 of the bat 100 having a reduced-durability region 1430 according to another embodiment of the present technology. The reduced-durability region 1430 in FIG. 14 is generally similar to the other reduced-durability regions described herein, including the reduced-durability region 1330 illustrated in FIG. 13 and described above. In some embodiments, there may be two appliances positioned in the gap region 260 (the gap region 260 may have multiple longitudinal gaps between plies 250). The appliances may be similar to other appliances described herein. In some embodiments, the appliances may be in the form of ring elements 1410 that may be generally similar to the ring elements 1310 described above with regard to FIG. 13. For example, the ring elements 1410 may have triangular cross-sections 1415 and they may be positioned anywhere in the gap region 260, within a discontinuity or break between composite laminate plies 250. In some embodiments, one or more plies (such as the through-ply 1417) may be positioned between the ring elements 1410, or a space between the ring elements 1410 may be filled with composite matrix material, or the space between the ring elements 1410 may be a void. The quantity, shape, and arrangement of ring elements 1410 functioning as appliances may be selected to tailor the force required to break through the bat wall 1400 in the reduced-durability region 1430 before the composite laminate plies delaminate.

In embodiments that include a single appliance, such as the embodiments described above and illustrated in FIGS. 8 and 10-13, or a plurality of appliances (spaced apart or adjacent to each other), such as the embodiment described above and illustrated in FIG. 14, a bond strength between an appliance and the composite matrix or resin may be designed to be close to or greater than the interlaminar strength of nearby plies 250. In such embodiments, there may be a risk that interlaminar failure occurs before the bond between the appliance and the matrix or resin is broken, leading to increased bat performance. To reduce that risk, in some embodiments, a designer may provide through-plies in the reduced-durability region, and the designer may provide a weaker bond between the through-plies and other plies or appliances.

Figure 15:
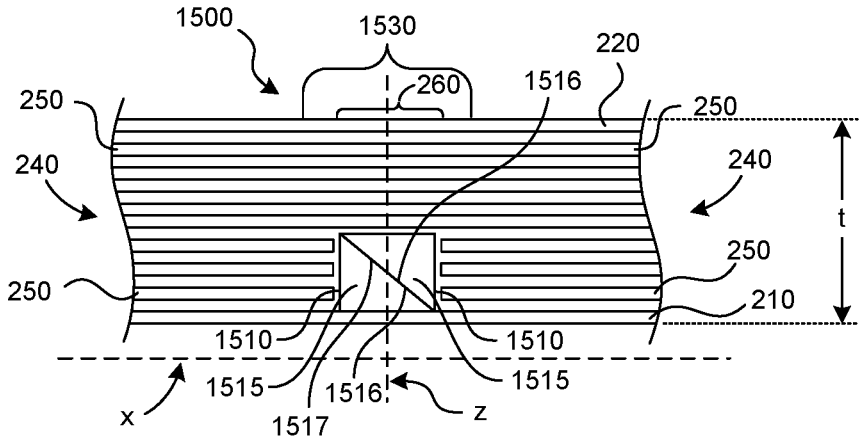

FIG. 15 illustrates a partial cross-sectional view of a portion of a composite barrel wall 1500 in the straight section 160 of the bat 100 having a reduced-durability region 1530 according to another embodiment of the present technology. The reduced-durability region 1530 in FIG. 15 is generally similar to the other reduced-durability regions described herein, including the reduced-durability region 1330 illustrated in FIG. 13 and described above. In some embodiments, the appliance may be in the form of a plurality of ring elements 1510 (such as two or more) having cross-sections 1515 that provide an interface 1517 between the ring elements 1510. For example, two ring elements 1510 may each have a triangular cross-section 1515 with a base edge 1516, and the base edges 1516 may be positioned adjacent to each other to form the interface 1517 between corresponding faces of the ring elements 1510. The base edges 1516 may be joined together with an adhesive or matrix material, or they may not be joined together at all. The triangular cross-sections 1515 may be sized to generally occupy the entirety of the wall 1500 between the skins 210, 220, or they may be sized to occupy only a portion of the wall 1500, such as 25% of the wall thickness t. Accordingly, the gap region 260 may include some plies 250 with discontinuities and some plies 250 that do not have discontinuities in the gap region 260 (through-plies).

Embodiments with interfaces between a plurality of rings (such as the ring elements 1510) or between other portions of appliances, such as the interface 1517 illustrated in FIG. 15, may include a bond between the base edges 1516 at the interface 1517 that is weaker than a bond between the ring elements 1510 and the surrounding composite matrix or resin material. In such embodiments, there is a reduced risk of delamination between plies 250 along the X-axis due to the tendency of the bond at the interface 1517 to break before delamination occurs. Accordingly, the bond at the interface 1517 may break before the bat gains performance.

In some embodiments, the faces of the rings or other appliances in contact with each other at the interface 1517 may be partially or completely coated with, treated with, or otherwise include a release material or a bond-resistant material to resist bonding with the composite matrix in the wall and to control the strength of the bond at the interface 1517. In some embodiments, the faces of the rings or other appliances may be bonded to each other using a full or partial coating or treatment of adhesive having a selected bond strength, so that the interface 1517 includes a bond of adhesive, release material, or a combination of adhesive and release material distributed in portions of the interface. For example, a bat designer may select the amount and position of adhesive and release material to tailor the bond strength at the interface 1517, such as making the bond strength at the interface 1517 lower than the strength of the surrounding matrix bond with the appliances. In a particular example, a cyanoacrylate or other epoxy resin may be selected to provide lower bond strength in the interface 1517 than the bond strength between the appliances and the surrounding composite matrix material in the wall.

Although FIG. 15 illustrates an interface 1517 that is oriented at a non-parallel angle relative to the Z-axis, the interface 1517 may be oriented at any suitable angle. For example, the interface 1517 may be parallel to the Z-axis, in which case the ring elements 1510 may have square or rectangular cross-sections.

Figure 16:
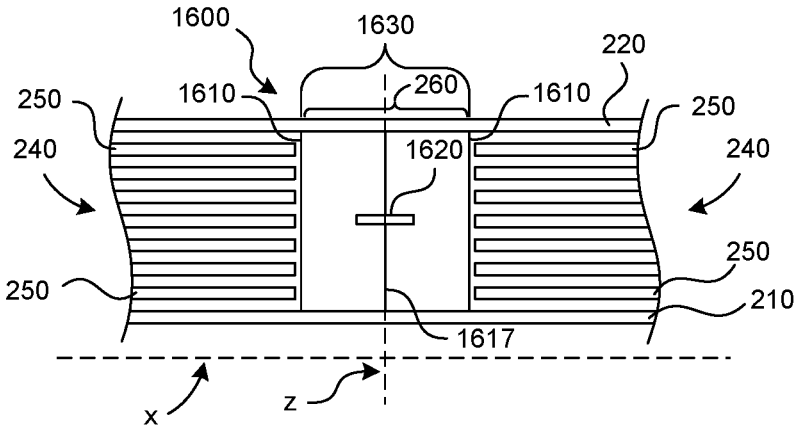

FIG. 16 illustrates a partial cross-sectional view of a portion of a composite barrel wall 1600 in the straight section 160 of the bat 100 having a reduced-durability region 1630 according to another embodiment of the present technology. The reduced-durability region 1630 in FIG. 16 is generally similar to the other reduced-durability regions described herein, but with an alternative arrangement of appliances. In some embodiments, a pair of ring elements 1610 may be positioned inside the wall 1600 between the skins 210, 220 and facing each other, such as abutting each other at an interface 1617. The interface 1617 may be similar to the interface 1517 described above with regard to FIG. 16, such that it may be fully or partially coated with adhesive or release material depending on the bond strength desired by a designer.

In some embodiments—instead of or in addition to adhesive or release material—the interface 1617 may include a plurality of connecting elements 1620 distributed around the circumference of the barrel wall 1600. In some embodiments, the connecting elements 1620 may include thread positioned and configured to hold the ring elements 1610 together along the X-axis but configured to fail in shear (along the Z-axis) under stresses associated with ABI protocol. In some embodiments, the connecting elements 1620 may include pins formed from a rigid or semi-rigid material. The connecting elements 1620 may be formed with metal, plastic, composite resin matrix, thread (such as cotton, nylon, or other thread material), wood, or other materials suitable for providing a connection between the ring elements 1610 in the interface 1617. In another embodiment, connecting elements may be integral with the rings or appliances.

Figure 17:
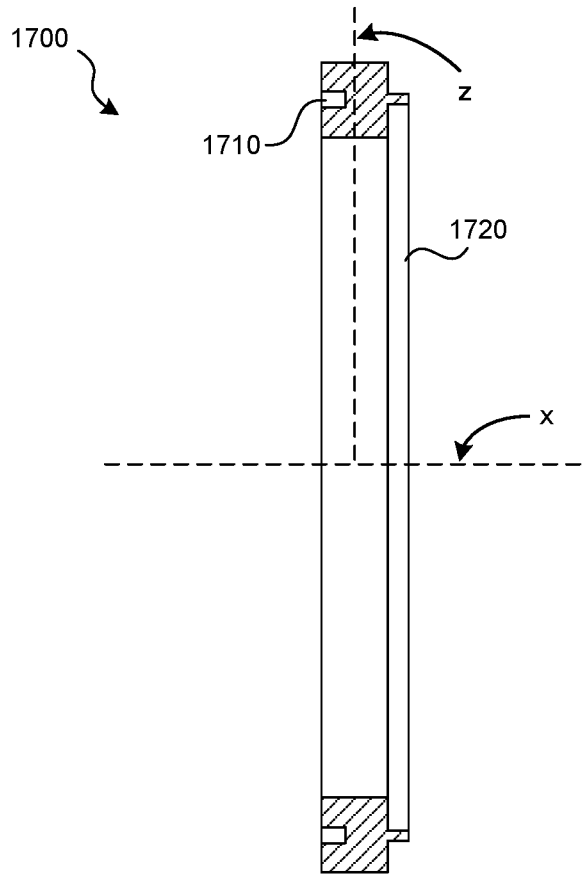
FIG. 17 illustrates a cross-sectional view of an appliance in the form of a ring element according to another embodiment of the present technology.

For example, FIG. 17 illustrates a cross-sectional view of an embodiment of a ring element 1700 that may be used as an appliance in a reduced-durability region, such as the reduced-durability region 1630 in FIG. 16. The ring element 1700 may include connecting elements in the form of a groove 1710 and a protrusion 1720, so that a plurality of rings 1700 (such as two or more) may be stacked or nested. The protrusion 1720 in a first ring element 1700 may be positioned in a groove 1710 of a second ring. The protrusion 1720 in the groove 1710 provides a shear interface that functions similarly to the connecting element 1620 described and illustrated above with regard to FIG. 16. For example, the protrusion 1720 may be configured to break or shear off when stresses in an ABI procedure are applied to a bat wall, at a lower stress than stresses that cause adjacent composite laminate plies to delaminate. In some embodiments, instead of an integral protrusion 1720, a thin ring of material with selected strength may be attached to each ring element 1700. In some embodiments, such a thin ring of material, or the protrusion 1720, may be, but need not be, continuous around a circumference of the ball bat. For example, the thin ring of material or the protrusion 1720 may be segmented to further tailor the shear strength between the rings 1700 in a reduced-durability region.

Figure 18:
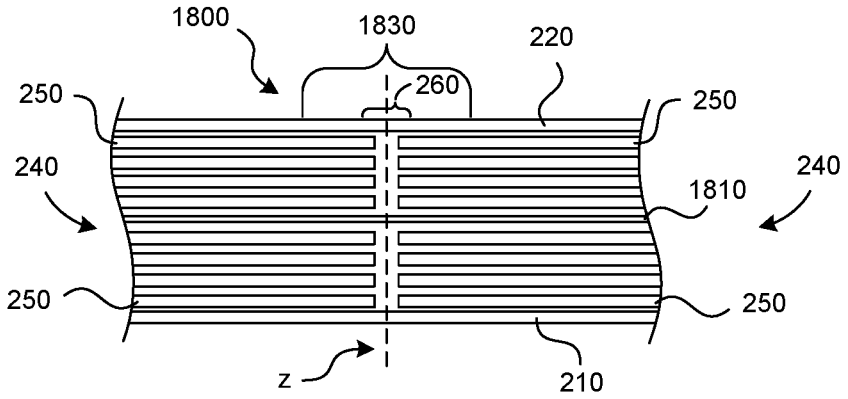

FIG. 18 illustrates a partial cross-sectional view of a portion of a composite barrel wall 1800 in the straight section 160 of the bat 100 having a reduced-durability region 1830 according to another embodiment of the present technology. The reduced-durability region includes a gap region 260 between the stacks 240 of plies 250. There may be one or more appliances positioned in the gap region 260, according to various embodiments described above. Additionally or alternatively, an appliance may be in the form of a through-ply 1810 positioned in the stacks 240 of plies 250, such that the gap region 260 does not extend a full thickness of the barrel wall 1800 between the inwardly facing skin 210 and the outwardly facing skin 220. Any number of through-plies 1810 may be positioned in the barrel wall 1800. The through-ply or through-plies 1810 further facilitate tailoring the strength of the reduced-durability region 1830. For example, a through-ply may strengthen the gap to delay delamination during an ABI process. The through-plies 1810 may be formed from any suitable composite material, including those described above.

Figure 19:
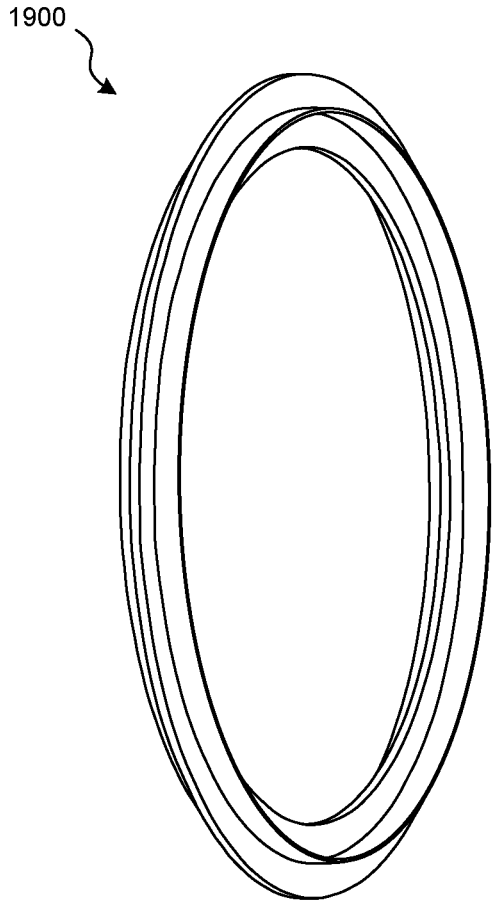

FIG. 19 illustrates an appliance in the form of a ring element 1900 having a t-shaped cross-section, according to an embodiment of the present technology. The ring element 1900 may otherwise be similar to other ring elements illustrated and described herein. The t-shaped ring element 1900 provides a different surface area and different bond characteristics with the surrounding composite matrix material to facilitate a further option for tailoring the strength of a reduced-durability region.

In embodiments of the present technology that implement ring elements, the ring elements may be positioned in the bat wall during the composite laminate layup process. For example, an inwardly facing skin 210 may be wrapped around a mandrel, followed by one or more composite laminate plies 240. During the assembly process, a ring element may be slid onto the assembly or otherwise positioned around the mandrel within the composite layup. Then other layers, such as composite laminate plies 240, may be positioned adjacent to or on top of the ring element, followed by the outwardly facing skin 220, after which the structure may be cured. In some embodiments, pre-preg composite laminate material may be used. In other embodiments, resin transfer molding (RTM) processes may be used, in which laminate plies 240 are impregnated with resin after being laid up around the mandrel. Other assembly processes may be used in accordance with embodiments of the present technology. For example, the inwardly facing skin 210, the outwardly facing skin 220, or both skins, may be omitted.

Although FIGS. 2-8, 10-16, and 18 illustrate space between various layers and appliances, in some embodiments the layers and components of embodiments of the present technology may be in generally intimate contact (via any resin or adhesive employed in the various embodiments).

Embodiments of the present technology provide reduced-durability regions to deter or discourage bat alteration. For example, if a user attempts to roll or perform other ABI processes, stresses in the bat wall will be focused along the gap between composite stacks rather than between the plies in the stacks, which will cause the wall of the bat to fail (destroying the bat) before significant delamination occurs that would otherwise improve performance. In addition, the present technology may provide a visual or tactile indicator of a failure of the bat wall prior to delamination (if any) between plies. Accordingly, the present technology allows for improved testing, improved indication of bat failure, and it may deter players from attempting to alter a bat.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements. For example, in various embodiments of the present technology, more than one separation ply may be used, or separation plies may be omitted. One or more cap ply elements (such as cap ply elements 310) may be omitted. Through-plies may be positioned within the composite laminate wall between appliances or between appliances and the skins 210, 220.

Figure 20:
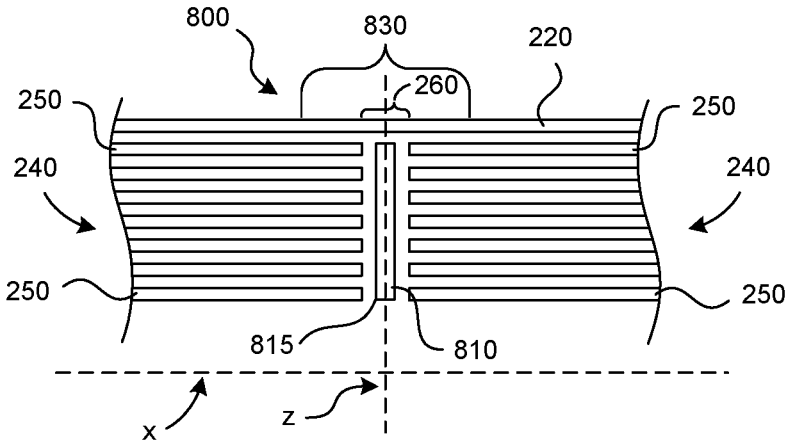

Several embodiments of the present technology are described and illustrated as having inwardly facing skins (for example, inwardly facing skins 210, 610 described above) or outwardly facing skins (for example, outwardly facing skins 220, 620), or both inwardly and outwardly facing skins, which may cover the appliances (such as separation plies 270, cap ply elements 310 or 750, appliances in the form of ring elements, or other appliances). However, in some embodiments, inwardly facing skins, outwardly facing skins, or both inwardly and outwardly facing skins may be omitted, such that the appliances form part of an outermost layer of a barrel wall or are exposed to the hollow interior of a bat, the outside environment of a bat, or both (see FIG. 20). In some embodiments, one or both of the cover layers 650 covering the gap region 260 in FIG. 6 may be omitted.

Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology may encompass other embodiments not expressly shown or described herein, and the invention is not limited except as by the appended claims.

What is claimed is:

1. A ball bat comprising a handle, a barrel attached to or continuous with the handle along a longitudinal axis of the bat, the barrel having a barrel wall defining a hollow interior region of the barrel, and a reduced-durability region positioned in the barrel wall, wherein the reduced-durability region includes:

two adjacent stacks of composite laminate plies, wherein the stacks are spaced apart from each other along the longitudinal axis to form a first gap therebetween, wherein the first gap extends to the hollow interior region of the barrel;

a first ring element positioned in the first gap between the stacks;

wherein a first bond between the first ring element and adjacent composite matrix material is weaker than a second bond between the composite laminate plies in each of the two adjacent stacks; and a second ring element, wherein the second ring element is attached to the first ring element with a third bond that is weaker than the second bond.

2. The ball bat of claim 1 wherein the first ring element comprises a rigid or semi-rigid material.

3. The ball bat of claim 2 wherein the first ring element comprises a plastic material.

4. The ball bat of claim 1 wherein the first ring element has a cross-section that is oriented perpendicular to the longitudinal axis.

5. The ball bat of claim 1 wherein the first ring element has a cross-section that is oriented at an oblique angle relative to the longitudinal axis.

6. The ball bat of claim 1 wherein the barrel wall comprises an outwardly facing skin facing away from the barrel.

7. The ball bat of claim 1 wherein the first ring element has triangular cross-section.

8. The ball bat of claim 1 wherein the second ring element is spaced apart from the first ring element, and wherein a composite laminate ply is positioned between the first ring element and the second ring element.

9. A ball bat comprising a barrel with a composite laminate, wherein the composite laminate includes:

an outwardly facing skin;

an inwardly facing skin;

a stack of composite laminate plies positioned between the outwardly facing skin and the inwardly facing skin;

a discontinuity in the stack, the discontinuity forming a gap in the stack;

a pair of appliances positioned in the gap, the pair of appliances comprising a first appliance and a second appliance connected to the first appliance with a first bond at an interface between the first appliance and the second appliance;

wherein the first bond is configured to fail under a first stress, a second bond between the appliances and the composite laminate plies is configured to fail under a second stress, a third bond between two of the composite laminate plies is configured to fail under a third stress, and wherein the first and second stresses are less than the third stress.

10. The ball bat of claim 9, wherein the first appliance is a ring element.

11. The ball bat of claim 10 wherein a cross-section of the ring element is oriented at an oblique angle relative to a longitudinal axis of the bat.

12. The ball bat of claim 10 wherein a cross-section of the ring element is triangular.

13. The ball bat of claim 9 wherein the first appliance is further connected to the second appliance with a connecting element.

14. The ball bat of claim 13 wherein the connecting element is configured to fail at a lower stress value than the third stress.

* * * * *